US005136734A

United States Patent [19]

Yli-Kovero

[11] Patent Number: 5,136,734

[45] Date of Patent: * Aug. 11, 1992

[54] METHOD OF HEATING A SAUNA AND A SAUNA STOVE

[76] Inventor: Risto T. Yli-Kovero, Tähkätie 8, 00390 Helsinki, Finland

[ * ] Notice: The portion of the term of this patent subsequent to Aug. 11, 2007 has been disclaimed.

[21] Appl. No.: 90,800

[22] PCT Filed: Dec. 1, 1986

[86] PCT No.: PCT/FI86/00140

§ 371 Date: Jul. 29, 1987

§ 102(e) Date: Jul. 29, 1987

[87] PCT Pub. No.: WO87/03193

PCT Pub. Date: Jun. 4, 1987

[30] Foreign Application Priority Data

Dec. 2, 1985 [FI] Finland ..... 854753

[51] Int. Cl.[5] ..... A61H 33/06

[52] U.S. Cl. ..... 4/524; 4/535

[58] Field of Search ..... 4/524, 535; 219/362, 219/365, 271, 276, 378, 341; 128/367, 368, 371, 373, 374, 375

[56] References Cited

U.S. PATENT DOCUMENTS 4,112,281 9/1978 Epps ..... 4/524 X

FOREIGN PATENT DOCUMENTS 732713 4/1966 Canada ..... 219/365
516480 1/1931 Fed. Rep. of Germany ..... 219/365
2160571 12/1973 Fed. Rep. of Germany .
2602360 8/1977 Fed. Rep. of Germany .
27821 12/1955 Finland .
61130 2/1982 Finland .
66532 7/1984 Finland .
35887 12/1911 Sweden .
1056613 1/1967 United Kingdom .

*Primary Examiner*—Henry J. Recla
*Assistant Examiner*—Robert M. Fetsuga
*Attorney, Agent, or Firm*—Fish & Richardson

[57] ABSTRACT

A method of heating a sauna and a sauna stove. In order that the energy consumption would be low, the stones in a stone space (11) of the stove are first heated to a desired temperature by circulating air within the stove by means of a fan (15) as a closed force circulation merely through the stone space (11). After the desired temperature has been achieved, the air is begun to be circulated by means of the fan (5) as an open forced circulation through the stone space (11) and the sauna room.

4 Claims, 1 Drawing Sheet

METHOD OF HEATING A SAUNA AND A SAUNA STOVE

Figure 1:
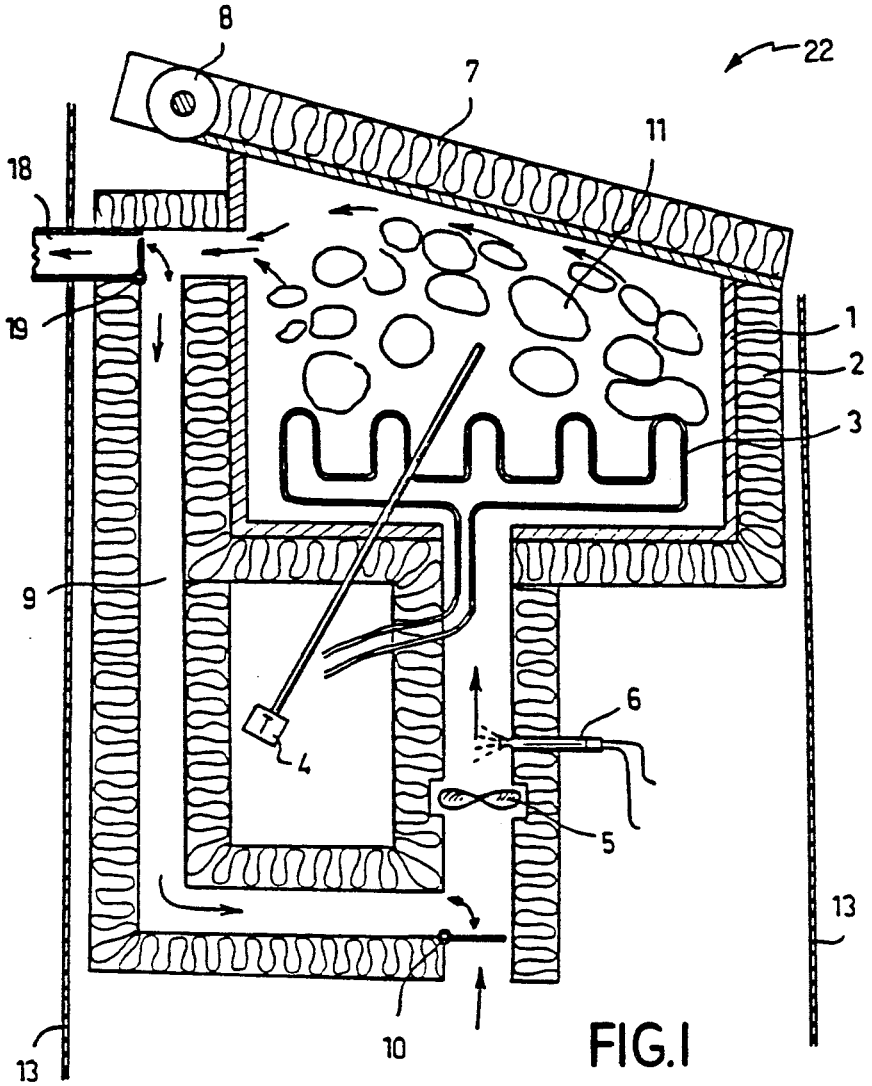

The invention relates to a method of heating a sauna, wherein the air in the sauna room is heated by means of a heatable stove positioned within the sauna room, and to a sauna stove for applying the method.

Previous electric sauna stoves can be heated ready for use in about 30 to 90 minutes. The air circulates therein through a so called natural circulation from between the stove stones into the sauna room. The stoves are so constructed that the stove stones and the air contained in the sauna room are heated simultaneously. A stove recommended for a sauna of a certain volume heats the sauna within the temperature range from 80° to 110° C. in such a manner that a desired bathing temperature and a sufficient stove temperature are achieved nearly simultaneously. With commercially available sauna stoves, the bathing temperature is adjusted by heating the stove until the temperature of the air in the sauna room reaches the bathing temperature. Thereafter the stove stones are not any longer heated, and they begin to cool. When the temperature of the air in the sauna room drops below a set value, the heating of the stove is restarted. Especially when the door of the sauna is kept closed for a long time, the sauna stove may wholly lose its steam generating capacity. This is due to the fact that even though the stove is not being heated, it keeps emitting heat to the air contained in the sauna room, so that the air gets increasingly warm while the stove cools. The air contained in the sauna room does not begin to cool until the stove has wholly lost its steam generating capacity.

One example of known solutions would be the sauna stove disclosed in Finnish Patent Specification 66,532. This sauna stove is divided into two parts to be heated separately, i.e. a stone space and an air channel. The stone space thereby includes a heating element for the stove stones, and the air channel correspondingly a heating element for the air contained in the sauna room. The stone space is further provided with a thermostat for the adjustment of the temperature of the stove stones. This arrangement is intended to ensure that the temperature of the stove and, accordingly, the steam generating capacity thereof, would not drop too low. Also, attempts have been made to prevent the excessive cooling of the stove by means of an arrangement in which the thermostat at first switches off the heating only partially, so that part of the heating efficiency is still on.

Another example of the prior art is the sauna stove disclosed in Finnish Patent Specification 61,130, in which the heating resistors are separated from the stone space by means of an absorption surface.

Known sauna stoves and systems for adjusting the bathing conditions have e.g. the following disadvantages. The heating efficiency and the stone volume of the stove, and the volume of the sauna room are strictly dependent on each other. The heating time of the sauna cannot be substantially shortened by increasing the heat efficiency of the stove, because with a shorter heating time the thermostat will turn off the heating before the stove stones have time enough to warm up in such a manner as is required for the achievement of good steam generating properties. The steam generating capacity of the sauna stove cannot be substantially improved by adding stones to the stove, because the preheating time thereby becomes unreasonably long, or the stove stones never get sufficiently hot if the thermostat turns off the heating too early in view of the warming of the stove. The bathing temperature and the steam generating capacity of the stove are strictly dependent on each other, and are operative only within the narrow temperature range from 80° to 110° C. In constant use, e.g. in saunas common to several apartment, it is not usually possible to maintain a good steam generating capacity if the sauna thermostat is not set to at least 100 degrees. In other words, it is not usually possible to have a good sauna bathe by throwing water on the stove stones when the heating temperature is low, i.e. 60° to 70° C.

The bathing conditions in sauna which belong to several apartments and which are used by several families in succession cannot be adjusted individually according to the requirements of each bather; instead, the temperature of the sauna room is adjusted to a high value for maintaining the steam generating capacity, as a result of which bathers who do not like an intense heat, usually children and old people, cannot at all throw water on the stove stones but they have to content themselves with a dry heat.

When the air and the stove are heated simultaneously, the energy consumption is unnecessarily high, because a major part of the energy is consumed to the heating of the ceiling, walls and benches of the sauna. This also affects adversely the bathing conditions, which, in turn, results in that many a bather in an apartment building starts his bath by cooling the burning hot benches and walls by means of water. The resulting dissipation of heat is so great that the concrete walls of the sauna room require the choice of a larger stove than normally.

The object of the invention is to provide a method of heating a sauna and a sauna stove, by means of which the drawbacks of the prior art can be obviated. This is achieved by means of a method according to the invention which is characterized in that the sauna stove is first heated to a desired temperature by circulating air within the stove only through a heatable stone space as a closed forced circulation, whereafter the air contained in the sauna room is begun to be heated by circulating air as an open forced circulation known per se through the stone space and the sauna room. The sauna stove according to the invention, in turn, is characterized in that the stove comprises a cover for tightly closing the stone space, and a stove air circulation channel, and that the fan is arranged to circulate air within the stove through the stone space and the circulation channel as a closed forced circulation when the cover is closed and as an open forced circulation known per se through the stone space and the sauna room when the cover is open.

The invention is advantageous mainly in that the sauna is heated as rapidly as possible and with a low energy consumption, because the sooner the stove and the air contained in the sauna room are heated, the less the amount of energy bound to be sauna walls and ceiling. As the air within the stove can be circulated, it is also possible to recover the heat remaining in the stove e.g. after the sauna bath and transfer it to other localities. This possibility to recover the heat implies that the sauna room and other localities can be heated by means of the stove, so that no other heating system is needed. In addition, the stove according to the invention is fairly simple in spite of the versatility thereof, wherefore the manufacturing costs are low.

Figure 2:
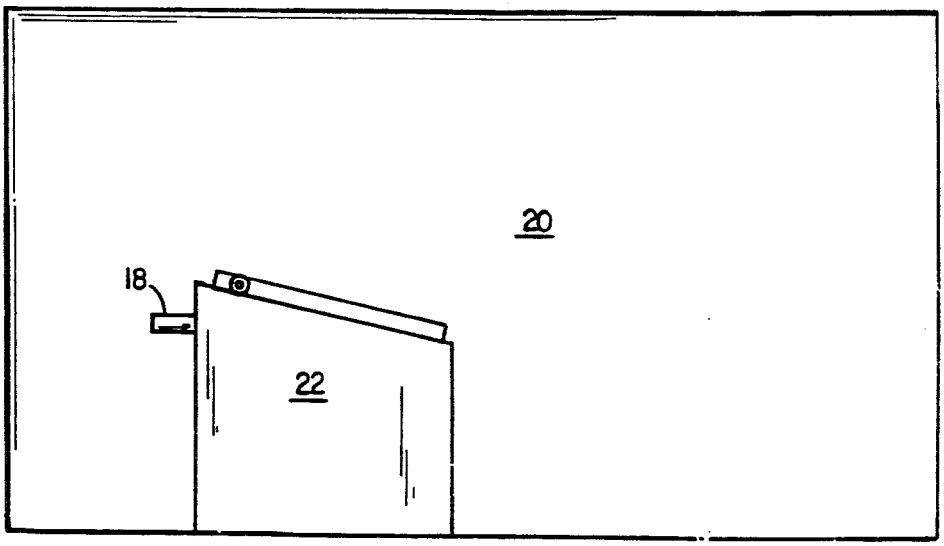

The invention will be described in the following in more detail by means of a preferred embodiment illustrated in the attached drawings, whereby FIG. 1 is a general sectional view of a sauna stove according to the invention and FIG. 2 shows the sauna stove in the sauna room.

In the example of FIG. 1, the reference numeral 1 indicates an inner shell of the sauna stove 22. The inner shell 1 is heat-insulated by means of a heat insulator 2. A stone space and stones of the stove, in turn, are indicated by means of the reference numeral 11. A heating element 3 for the stove stones is positioned within the stone space 11 as well as a sensor 4 for measuring the temperature of the stove stones. An outer shell of the stove is indicated by means of the reference numeral 13 in FIG. 1.

The stove according to FIG. 1 further comprises a cover 7 by means of which the stone space 11 can be closed tightly. The cover 7 is pivotable by means of a cover displacing mechanism and an articulation 8. The stove also comprises a fan 5 which is arranged to blow air through the stone space 11. For the circulation of the air the stove is provided with a stove air circulation channel 9, a circulation air selection valve 10, a heating channel 18, and a heating channel selection valve 19. Furthermore, a spraying apparatus 6 is positioned on the pressure side of the fan in the example of FIG. 1 for the adjustment of the relative humidity of the air in the sauna room.

According to the basic idea of the invention the stove is first heated to a desired temperature by circulating air merely within the stove as a closed forced circulation through the stone space 11. After the stone space 11 has reached the desired temperature, an open forced circulation of air is started through the stone space 11 and the sauna room 20 (FIG. 2) for heating the air contained in the sauna. The idea is thus that the stones in the stone space 11 are first rapidly heated to the desired temperature. During this heating step the air in the sauna room is not at all heated; it is not heated until the temperature of the stones reaches the desired level. It is clear that the heating of the stone space can be carried out completely before the heating of the air in the sauna room, but it is also possible to first heat the stone space to a certain temperature, whereafter the stone space and the sauna air are heated simultaneously.

An advantage of the above principle in view of the structure is, among others, that the inner shell 1 of the stove can be made of a material having a poor electrical conductivity, with the result that the electrical security of the stove is improved and the structure of the stove is easier to design for easy assembly. The inner shell of previous stoves is made of steel or some other material having a good thermal conductivity and at the same time a good electrical conductivity in order that the air in the sauna room would be heated simultaneously as the stove is heated.

The rapid heating of the stove according to the invention can be further speeded up by constructing the inner shell 1 of a material having a poor thermal conductivity and by coating the inner face of the inner shell 1 with a material reflecting radiation heat.

The stove according to the invention operates from the beginning of the heating in the following way. The cover 7 of the stove is closed, because the stove is cold. The heating elements 3 start to heat the stone space 11. The circulation air selection valve 10 opens the stove air circulation channel 9. The fan 5, which effects a forced circulation of air through the stone space 11, starts to circulate the stove air within the stove. When the temperature in the stone space 11 reaches a set value, the cover opening mechanism 8 opens the cover, and the circulation air selection valve 10 closes the stove air circulation channel and simultaneously opens the channel leading outside the stove. Thereby the fan 5 starts to circulate the air as an open forced circulation through the sauna room. At this stage, it is of advantage that the spraying apparatus 6 starts to spray water into the stove, because steam transfers heat more efficiently than dry air.

After the temperature of the air contained in the sauna room has reached a desired value, the open forced circulation of the sauna air through the stone space 11 of the stove is stopped, and the sauna is ready to be used. The temperature of the stove stones is constantly kept within desired limits irrespective of the temperature of the sauna room.

The operation of the fan 5 and the position of the cover 7 can, of course, be adjusted in various ways. An adjustment depending upon e.g. the temperature of the stove stones, the temperature of the sauna room, the amount of energy consumed to the heating of the stove, the time spent on the heating of the stove, or the different combinations of these matters, is fully possible. It is also possible to make the stove manually adjustable so that the fan and/or the position of the cover are adjusted manually on the basis of the temperature of the stones and/or the sauna room.

The above embodiment is by no means intended to restrict the invention, but the invention can be modified within the claims in various ways. Accordingly, the method, e.g., is by no means restricted to electric sauna stoves, but it can also be applied in connection with stoves heated in some other way. Heated air can be led through the heating channel 18 to any desired locality e.g. after the sauna bath, so that the heat from the sauna room can be utilized.

I claim:

1. A method of heating a sauna room, wherein the air contained in the sauna room is heated by means of a heatable sauna stove positioned in the sauna room, said sauna stove having a stone space within its interior and a cover for closing said stone space, said method comprising the steps of providing an unheated sauna room, sealing said stove from the sauna room so that appreciable heat does not escape from said stove unless said cover is open, uniformly heating only said stones in said stone space to a desired temperature using heating elements positioned within said stone space by using a fan to circulate heated air through said stone space without air escaping to said sauna room, after said stone space has reached a desired temperature, opening said cover, thereby opening said stone space to the air in said sauna room, and heating said sauna room by using a fan to circulate air through the stone space and the sauna room.

2. A method according to claim 1 wherein said stone space continues to be heated after said stone space is opened to said room.

3. A sauna stove for heating a sauna room, said stove comprising an insulated housing, an opening at the top of said housing defining and upper chamber in said housing, an insulated cover closing said opening and movable between a sealing position in which the interior of said chamber is sealed from the sauna room and an open position in which the interior of said chamber is exposed to the room, removable stove stones positioned in said chamber and located in full view through said opening when said cover is open, and said opening being sufficiently large to permit water to be applied to said stones by a user for generation of steam during use of said stove, heating elements positioned within said chamber in thermal contact with said stones, a fan and ducting within said housing for circulating air past the heating elements and through said chamber over said stones in a closed forced circulation when said opening is sealed by said cover, so that said chamber and stones are heated without appreciable heat being lost to the sauna room, means for redirecting said circulating air through the chamber and into the sauna room through said opening when said cover is open, whereby said sauna stove may be used to preheat stones in the chamber without at the same time appreciably heating the sauna room, the cover may be opened to heat the sauna room, and water may be applied to the heated stones through the opening.

4. The stove of claim 3 further comprising a temperature sensor positioned within the chamber and means responsive to said sensor for adjusting the temperature of the stove stones by adjusting the fan or the position of the cover.

* * * * *

UNITED STATES PATENT AND TRADEMARK OFFICE

CERTIFICATE OF CORRECTION

PATENT NO. : 5,136,734

DATED : August 11, 1992

INVENTOR(S) : Risto T. Yli-Kovero

It is certified that error appears in the above-indentified patent and that said Letters Patent is hereby corrected as shown below:

On the title page, Item [87] PCT Pub. No.:, "WO87/03193" should read --WO87/03194--.

Column 4, line 67, "and" should be --an--.

Signed and Sealed this

First Day of March, 1994

Bruce Lehman

*Attest:*

BRUCE LEHMAN

*Attesting Officer*

*Commissioner of Patents and Trademarks*